United States Patent [19]

Cowan et al.

[11] Patent Number: 5,048,893

[45] Date of Patent: Sep. 17, 1991

[54] ERGONOMIC CHAIR

[75] Inventors: Benjamin Cowan, 46 Heath Road, Montreal, Quebec, Canada, H3X 3L4; Marek Kmicikiewicz, Montreal, Canada; Christopher J. Scrase, Dorval, Canada; Bernard Shalinsky, Montreal, Canada

[73] Assignee: Benjamin Cowan, Montreal, Canada

[21] Appl. No.: 552,563

[22] Filed: Jul. 16, 1990

[51] Int. Cl.[5] ..... A47C 7/50

[52] U.S. Cl. ..... 297/329; 297/313

[58] Field of Search ..... 297/325, 329, 313

[56] References Cited

U.S. PATENT DOCUMENTS

| | | | |
|---|---|---|---|
| 160,624 | 3/1875 | Spencer | 297/329 X |
| 2,153,763 | 4/1939 | Kuhler | 297/329 |
| 2,210,863 | 8/1940 | Whedon | 297/329 |
| 2,217,756 | 10/1940 | Lichter | 297/329 |
| 3,135,550 | 6/1964 | Bosack | 297/329 |

FOREIGN PATENT DOCUMENTS

| | | | |
|---|---|---|---|
| 701049 | 12/1940 | Fed. Rep. of Germany | 297/329 |

*Primary Examiner*—Peter A. Aschenbrenner

*Attorney, Agent, or Firm*—Fleit, Jacobson, Cohn, Price, Holman & Stern

[57] ABSTRACT

A chair adapted to passively adjust itself to be in equilibrium with the user's body in relation to changes in the center of gravity and thigh inclination. The chair includes a post from which is provided, in one embodiment, a convex track on which a carriage is allowed to travel, and a seat pan is pivoted on the carriage for angle adjustment relative to the carriage. In another embodiment, a first concave track is provided on the top of the post with a carriage slidable in the concave track and a seat pan mounted for travel in a track on the carriage wherein the second concave track has a smaller radius than the first track.

10 Claims, 4 Drawing Sheets

ERGONOMIC CHAIR

BACKGROUND OF THE INVENTION

1. Field of the Invention

The present invention relates to a work station chair, and in particular, to a chair having a seat which can shift in response to different positions of a person working at a table or similar station which normally requires the person to lean forward in a working mode and to lean back in a rest position.

2. Description of the Prior Art

There have been many attempts to better design a seating arrangement for persons working at a desk or computer terminal. Such ergonomic chairs are described, for instance, in U.S. Pat. No. 4,650,249, issued Mar. 17, 1987 to Serber, and U.S. Pat. No. 4,738,487, issued Apr. 19, 1988 to Shalinsky et al.

In the Serber patent, a complicated body support system is illustrated which includes, amongst other things, an arcuate concave track system which allows the seat pan to slide through a concave arc. The track system is pivotally mounted to a base which leaves the seat pan quite unstable, unless the pivot is locked.

The Shalinsky et al patent includes a pivoting seat pan mounted to a stem which pivots at its base providing a convex arc for the forward tilting movement of the person sitting on the seat. This latter chair is satisfactory, but the radius of the arc is limited to the length of the stem from the base to the seat. The arc of movement, or tilt, is a function of the height of the person.

In the case of the Serber patent, it can be seen that when the seat pan slides forward, the center of gravity of the person moves forward past the pivot center causing the seat to tend to pivot forward to dump the load thereon. Unless the pivot is locked, the person will have to counteract this tendency.

SUMMARY OF THE INVENTION

It is an aim of the present invention to provide an improved work chair of the type described above, but without the disadvantages mentioned hereinabove.

It is a further aim of the present invention to allow the user to passively maintain the natural lordotic curvatures and integrated biomechanical relationship of the spine, pelvis and lower limbs in a balanced dynamic equilibrium while in the seated posture.

The demands of the seated work position mandate the user to accommodate a range of postural adjustments from the slightly rearward reclined rest position through to the forward hunched (i.e., trunk) task posture. Passive automatic adaptation or adjustment of the seat support system is required if the natural balance and equilibrium of the body's support is to be maintained. Failure to maintain the body's equilibrium and structural balance results in the creation of adverse static postural loads and forces responsible for the fatigue and biomechanical dysfunction so common in today's seated society.

A construction in accordance with the present invention comprises a chair having a base, at least a fixed stem extending vertically from the base, and an arcuate track fixed to the top of the stem and extending in a forward-rear direction. A carriage is mounted to the track for sliding movement thereon in the curve of the arcuate track. A seat pan is mounted on the carriage, and means are provided for allowing the angle of the seat pan to change relative to the carriage in order to provide a stable seat which changes position and attitude in response to the position of the user.

In an embodiment in accordance with the present invention, the track defines a convex arc and the carriage mounts a fixed pivot in an axis parallel to the axis of rotation of the arc, to which the seat pan is pivotally mounted.

In another embodiment in accordance with the present invention, the track defines a first concave arc, and the carriage defines a second concave track having an arc of a smaller radius than the first arc, the center of which is located at the "H" point of the body mechanism, therefore eliminating additional "linkage" between the H point and seat pan pivot point. The seat pan is adapted to follow the second track on the carriage.

An advantage of the present invention is that the seat pan can change its attitude as a result of different thigh angle, for instance, when the carriage is shifted as the user assumes a lean forward position in a work mode.

An advantage of the first embodiment is that the pivot point is over the convex track rather than under it as in the Serber patent. Thus, the track stays fixed, but the seat pan pivots relative to the carriage. Thus, as the carriage is drawn forward by the user advancing to a work mode, the seat pan can adjust to the changing thigh angle.

In the second embodiment, when the carriage is slid according to a shift in the center of gravity, the seat pan will slide in its small arc to adjust to the changing thigh inclination, while the first arc will seek its new position until the new balance is achieved. Thigh, body trunk, and seat pan have the same rotation center, which is the H point.

BRIEF DESCRIPTION OF THE DRAWINGS

Having thus generally described the nature of the invention, reference will now be made to the accompanying drawing showing by way of illustration, a preferred embodiment thereof, and in which.

DESCRIPTION OF THE PREFERRED EMBODIMENTS

Figure 1:
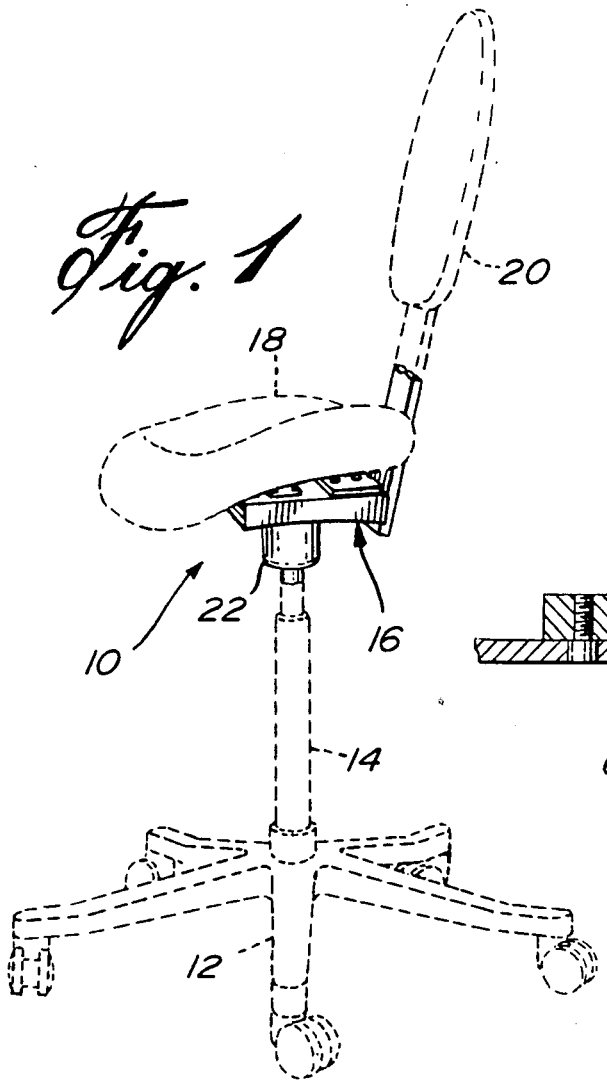
FIG. 1 is a perspective view, partly shown in dotted lines, of a chair in accordance with an embodiment of the present invention.

Referring now to the drawings, there is shown, in the embodiments of FIGS. 1 through 4, a chair 10 having a base 12 and a post 14 extending vertically from the base 12 to which is mounted a seat pan 18 on a carriage 16. A back rest 20 is mounted to the carriage 16.

Figure 4:
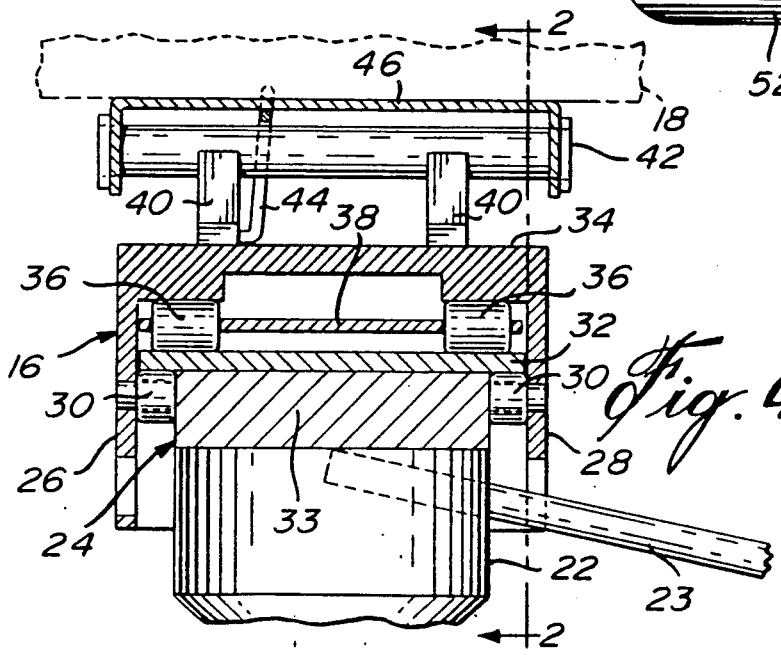
FIG. 4 is an enlarged fragmentary vertical cross-section, taken along line 4—4 of FIG. 2.
Figure 2:
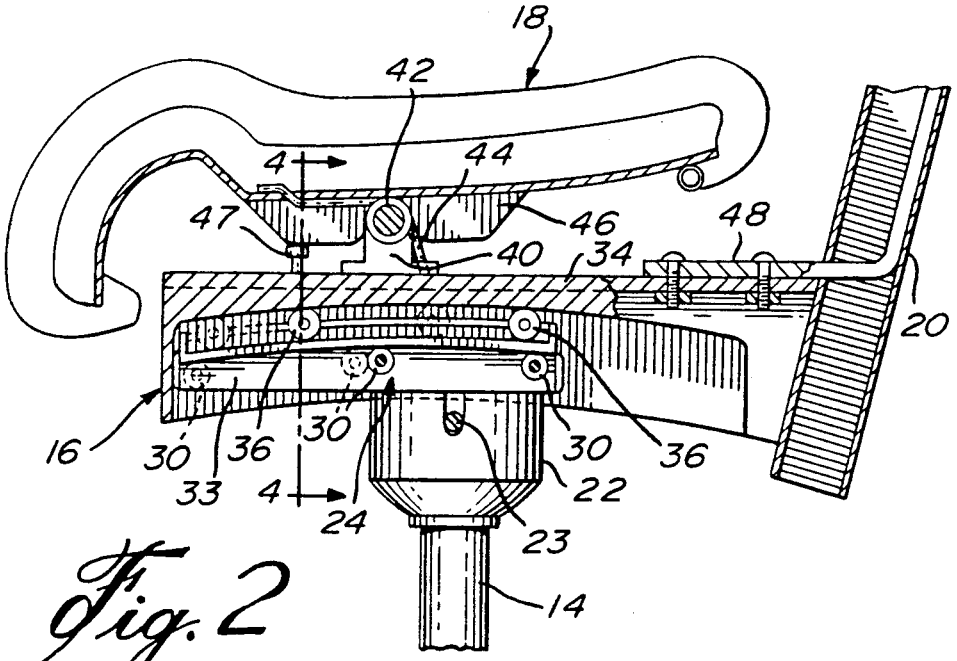
FIG. 2 enlarged fragmentary cross-section, taken through a vertical longitudinal plane of the chair in FIG. 1.
Figure 3:
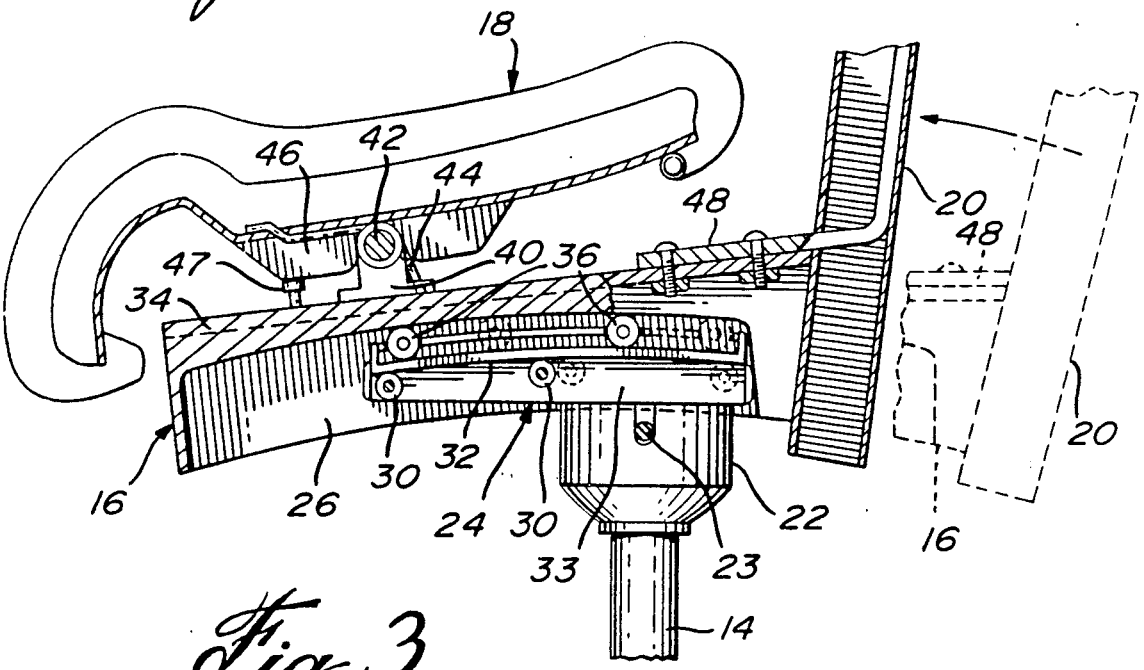
FIG. 3 is an enlarged fragmentary cross-section in the same plane as FIG. 2, showing the elements in a different operative position.

Referring more particularly to FIGS. 2 through 4, a seat mount 22 is fixed to the top of post 14 to which is mounted a track platform 24. The carriage 16 includes side walls 26 and 28 and a top wall 34. The track platform 24 includes a convex arcuate plate 32 mounted to a body 33. Rollers 30 are mounted for free rotation to walls 26 and 28 and are adapted to engage the bottom surface of the plate 32 near the edges thereof, as shown in FIG. 4. Rollers 36 ride on the race formed on plate 32 and support the top wall 34 of the carriage 16. A roller cage 38 is provided to maintain the freely rolling rollers 36 in proper spaced arrangement. There may be four rollers 36 and at least a pair of rollers 30. The rollers 30 serve to prevent the carriage from being easily removed from the track platform 24.

The track platform 24 including plate 32 has a radius of curvature which is greater than the height of the post, thereby having a more gradually curved arc. The platform 24 is cantilevered forward to the platform mount 22, as shown in FIGS. 2 and 3, to allow forward movement of the carriage.

Mounted on the top wall 34 of carriage 16 is a fixed pivot including pivot bracket 40 mounting a pivot shaft 42. The seat pan 18 also includes a bracket 46 mounted on the pivot shaft 42. The pivot shaft 42 allows the seat pan to pivot relative to the carriage 16 about a transverse axis, that is, forward and rearwardly. A torsion spring 44 resists the pivot movement of the seat pan 18. A post 47 may be provided forwardly of the pivot shaft 42 to limit the counterclockwise pivot movement of the seat pan 18.

A back rest 20 is mounted to the carriage 16 by means of a bracket 48.

In operation, the ergonomic raison d'être of the structure described herein is similar to that described in U.S. Pat. No. 4,738,487. However, the use of a convex arcuate track to allow the forward and rearward movement of the seat pan allows greater flexibility in selecting the proper arc. Where the above-mentioned United States patent had an arc limited to the length of the stem from the base to the height of the seat pan, and thus varied depending on the height of the user, the present chair allows a greater radius and, therefore, a smoother arc at all levels, and the amount of arcuate "tilting" movement is the same for all heights. Incidentally, the post 14 can be extended as is well known to adjust for different heights of users. The lever 23 actuates this action.

In the embodiment of FIGS. 1 to 4, the track platform 24 is cantilevered forward of the axis of the post 14 such that the pivot axis of shaft 42 can travel 3 to 4 inches forward of the post axis in the arc. Preferably, the radius of the arc is 27 inches or greater.

The seat pan 18 pivots about an axis 42 to adjust to the various thigh inclinations of the user, depending on whether the person is moving forward to a work mode or is leaning backward with a pivot shaft above the post 14, as shown in FIG. 2. The forward tilt of the seat pan may be 15° while the rearward tilt might be only 5°.

FIGS. 5 through 8 show a different embodiment of the present invention in which a post 50 mounts the platform mount 52. The track platform 54 is fixed to the platform mount 52, and a carriage 56 slides in a concave arc on the platform 54 as will be described. A seat pan 58 is also adapted to a concave arcuate sliding movement relative to the carriage 56 as will also be described.

Figure 5:
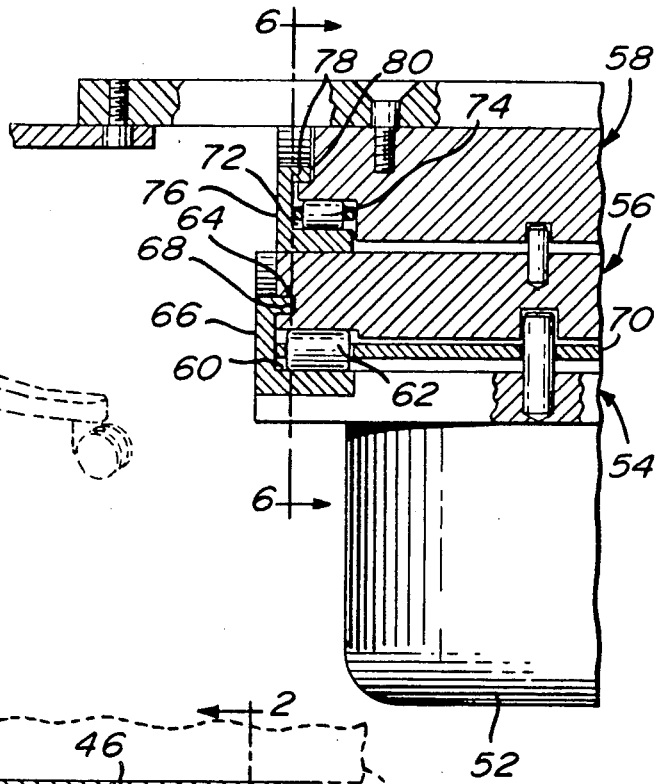
FIG. 5 an enlarged fragmentary vertical cross-section, taken in a vertical transverse plane of a chair of a different embodiment of the present invention.
Figure 6:
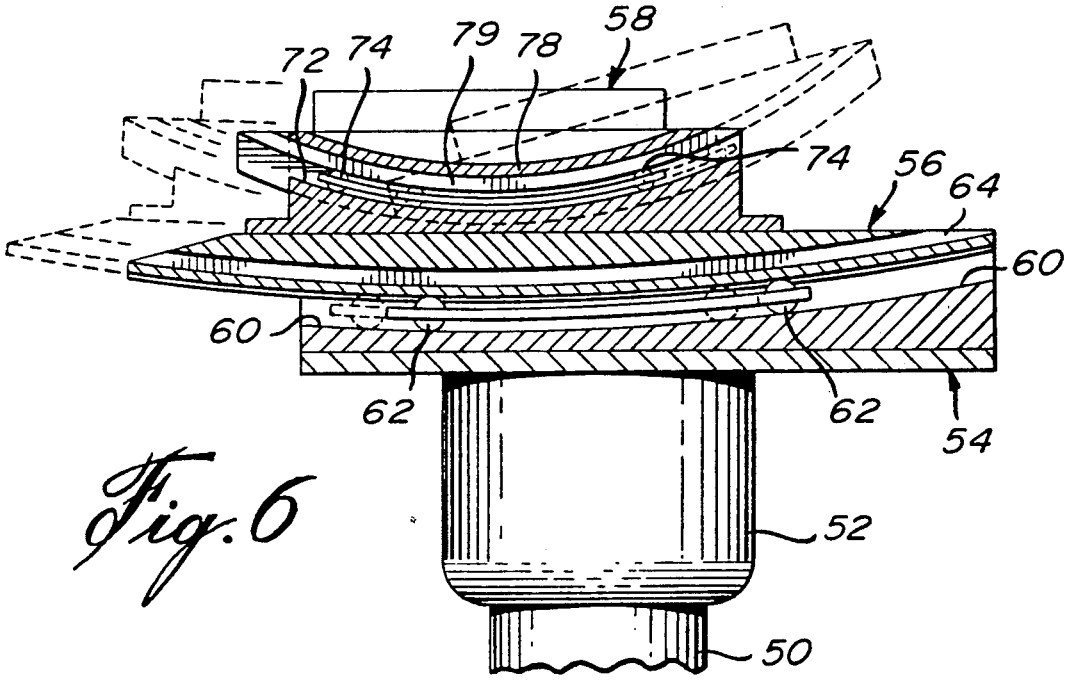
FIG. 6 is an enlarged fragmentary vertical cross-section, taken along line 6—6 of FIG. 5.
Figure 7:
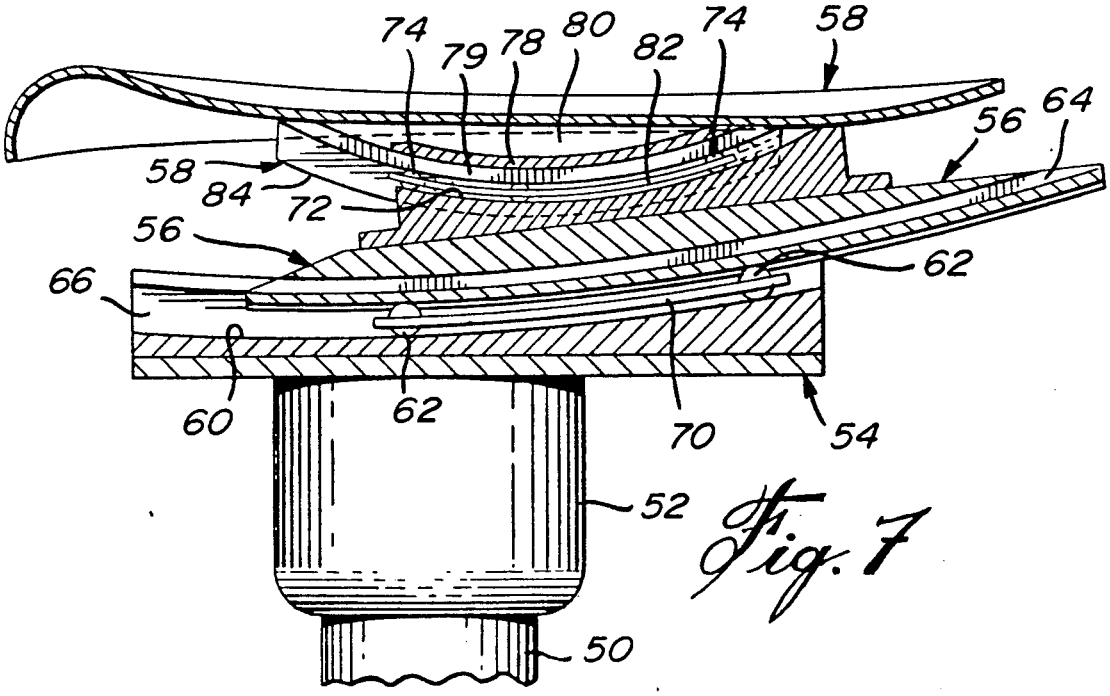
FIG. 7 is an enlarged fragmentary vertical cross-section, taken in the plane similar to FIG. 6 but in a different position.

Referring to FIGS. 5 through 7, the platform 54 includes a track race 60 on which rollers 62 are meant to roll freely. Track side walls 66 are provided on each edge of the platform 54 and include flanges 68 which engage in grooves 64 in the carriage 56 on each side thereof. The track race 60 has a concave arc which is selected. Through experimentation, it has been found that the radius of this concave arc can be approximately 24 inches when the chair is meant to be supported on rollers and meant to be used on industrial carpeting. The radius of the concave arc of the race 60 is a function of the rolling resistance between the surface of the floor and the casters. If the rolling resistance is high, the radius of the arc must be small. However, if the casters are running on a floor with low resistance, then the radius of the arc must be high. A roller cage 70 is provided in the track race 60 to maintain the spaced relationship of the freely rolling roller 62.

The carriage 56 sits on the rollers 62 and itself is provided with a track race 72 on which freely rotating rollers 74 can travel. The rollers 74 support the seat pan 58, that is, the seat pan platform 84 which is fixed to the seat pan 58. The track side walls 76 with flanges 78 engage shoulders 80 of seat pan platform 84.

Figure 8:
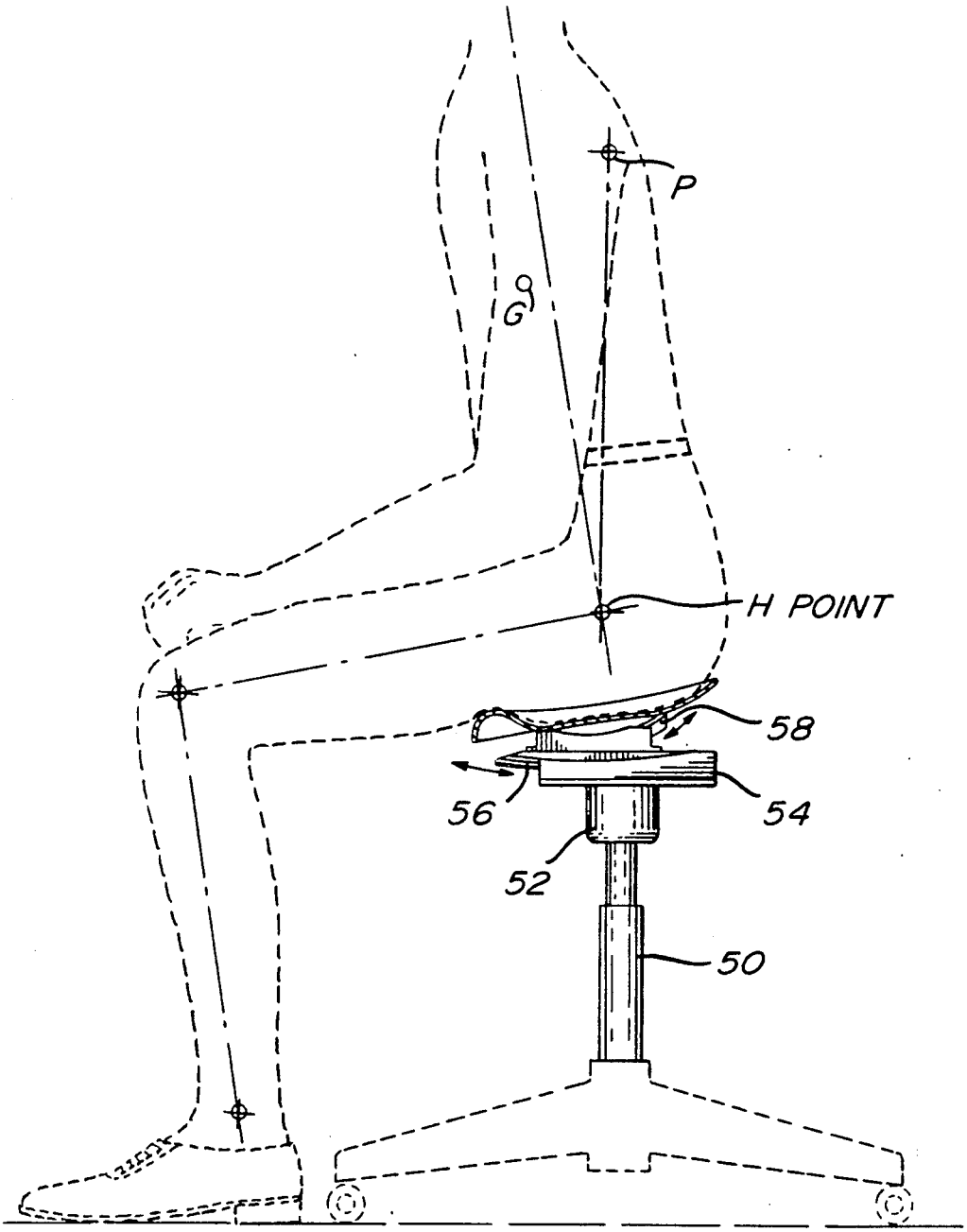
FIG. 8 is a fragmentary side elevation, partly schematic of the embodiment according to FIG. 5 and showing a user, in dotted lines, sitting on the chair.

The radius of the concave arc of the track 72 is approximately 7 inches which coincides with the center called the H point which is a natural pivot point of the torso and thigh lines, as seen in FIG. 8. The H point is defined in SAE standard J826. The radius of the arc of the track race 60 has a center P in FIG. 8 which is above the center of gravity G of the user. The torso line, shown in FIG. 8, intersects with the thigh line at the H point.

When the user moves forward towards a work mode position, the carriage 56 will travel on the track platform 54 in a concave arc to a natural equilibrium as a result of the shift in the center of gravity G and depending on whether the user is partly supported in the upper body, i.e., if he or she is supported by his or her elbows on the work surface. The seat pan 58 will travel on its track race 72 in an arc having its center at the H point, thereby adjusting to the thigh inclination. Likewise, both the seat pan platform 58 and carriage 56 will adjust as the user moves back to a rest position as a result in the shift of the G point and thigh inclination respectively.

We claim:

1. A chair comprising a base, at least a fixed stem extending vertically from the base, a track platform mounted at the top of the stem, a carriage mounted on the track platform for sliding movement in a convex arc relative to the carriage, one of the carriage and track platform mounting a track including at least a pair of bearing races provided in the forward and rearward directions, and the other of the carriage and track platform including bearings adapted to roll in the bearing races in the track, a seat pan mounted on the carriage for movement about fixed pivot in an axis at right angles to the direction of the bearing races, and resilient means associated with the seat pan to resist the pivoting movement of the seat pan.

2. A chair as defined in claim 1, wherein the track, including at least a pair of bearing races, is part of the track platform and the bearings adapted to roll in the bearing races are mounted to the carriage, and track retaining means are associated with the track platform and the carriage to maintain the carriage on the track platform.

3. A chair as defined in claim 1, wherein a back rest is fixedly mounted to the rear of the carriage.

4. A chair as defined in claim 2, wherein the track platform is cantilevered forward of the axis of the stem such that the arc of travel of the pivot axis of the seat pan on the carriage is 5° rearwardly of the axis of the stem and 15° forward of the axis of the stem.

5. A chair comprising a base, at least a fixed stem extending vertically from the base, a track platform mounted on the stem, and a carriage mounted to the track platform for sliding movement in a concave arc relative to the carriage, a first track mounted on one of the track platform and carriage, and a track follower mounted on the other of the track platform and carriage so that the carriage moves at least in the front and rearward direction in a first concave arc, a seat pan mounted for sliding movement on the carriage, a second concave track mounted on the one of the seat pan and carriage, and a track follower means mounted on the other of the seat pan and carriage so that the movement of the seat pan follows the second concave track having an arc of smaller radius than the arc of the first concave track.

6. A chair as defined in claim 5, wherein the first track forms part of the track platform and the track follower means of the first track are provided on the carriage, and the second track is formed in the carriage, with the track follower means of the second track provided on the seat pan.

7. A chair as defined in claim 5, wherein a back rest is fixedly mounted to the rear of the carriage.

8. A chair as defined in claim 5, wherein a pair of track races are defined in the concave arc in the front and rear direction of the chair, a carriage including bearing means rides on the track with the bearing means in the track races, and track retaining means mounted on the track platform and associated with the carriage for retaining the carriage on the track platform free to slide in the forward and rearward directions, the seat pan including a seat platform and the carriage including a pair of track races in the concave arc defined thereon, and the seat platform including bearing means adapted to run in the track races and track retaining means mounted on the carriage and associated with the seat platform for retaining the seat platform and seat pan on the carriage for free movement in the concave forward and rear directions.

9. A chair as defined in claim 8, wherein the radius of the concave arc of the first arcuate track race is selected as a function of the coefficient of friction between the chair and the surface supporting the chair wherein the radius is a function of the rolling resistance, while the radius of the arc of the second track race is generated from the H point.

10. A chair as defined in claim 8, wherein the carriage will slide in the track and the seat pan will angle relative to the carriage in the front and rearward direction to adapt passively and automatically in response to the shift in the center of gravity, of the user, and thigh inclination, thereby eliminating torque force in the user's back in different sitting postures.

* * * * *